US012135025B2

(12) United States Patent
Gutberlet et al.

(10) Patent No.: US 12,135,025 B2
(45) Date of Patent: Nov. 5, 2024

(54) DEVICE FOR COMPRESSING A GASEOUS FLUID

(71) Applicant: Hanon Systems, Daejeon (KR)

(72) Inventors: Dirk Gutberlet, Würselen (DE); Kadir Dursun, Cologne (DE); Michael Friedl, Pulheim (DE); Steffen Koch, Frechen (DE)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 18/191,419

(22) Filed: Mar. 28, 2023

(65) Prior Publication Data

US 2023/0340956 A1 Oct. 26, 2023

(30) Foreign Application Priority Data

Apr. 21, 2022 (DE) ..... 102022109664.5
Feb. 14, 2023 (DE) ..... 102023103497.9

(51) Int. Cl.
*F04C 18/02* (2006.01)
*F04C 29/02* (2006.01)
*F04C 29/12* (2006.01)

(52) U.S. Cl.
CPC ..... *F04C 18/0215* (2013.01); *F04C 29/026* (2013.01); *F04C 29/12* (2013.01)

(58) Field of Classification Search
CPC .. F04C 18/0215; F04C 29/026; F04C 29/028; F04C 23/008; F04C 29/02
See application file for complete search history.

(56) References Cited

U.S. PATENT DOCUMENTS 6,152,713 A 11/2000 Hisanaga et al.
7,413,422 B2 8/2008 Ito
(Continued)

FOREIGN PATENT DOCUMENTS

CN 211778004 U * 10/2020 ..... F04C 29/02
DE 102017207145 A1 * 10/2018 ..... F04B 35/04
(Continued)

OTHER PUBLICATIONS

English translation of DE 102017207145 by PE2E, Nov. 3, 2023.*
English translation of CN2011778004 by PE2E, Apr. 11, 2024.*
English translation of KR 20160040936 by PE2E Apr. 11, 2024.*

*Primary Examiner* — Deming Wan
(74) *Attorney, Agent, or Firm* — Shumaker, Loop & Kendrick, LLP; James D. Miller

(57) ABSTRACT

A device for compressing a gaseous fluid from a low-pressure section into a high-pressure section. The device has a housing with a housing member, a compression mechanism arranged between the low-pressure section and the high-pressure section as well as a flow duct connecting the high-pressure section to the low-pressure section. The housing member is configured with a high-pressure-side port and an oil separator. An outlet opening of the port and an oil outlet are configured at diametrical ends of the oil separator. The oil outlet is arranged in the lowermost section of the oil separator in a direction of the effect of gravity and is hydraulically connected to an inlet of the flow duct. The housing member is configured with the inlet chamber such that the high-pressure-side port is able to be arranged with the axis within the inlet chamber irrespective of the arrangement of the oil outlet.

19 Claims, 4 Drawing Sheets

(56) References Cited

U.S. PATENT DOCUMENTS

| | | | | |
|---|---|---|---|---|
| 7,736,136 | B2 | 6/2010 | Ohtake | |
| 2006/0171832 | A1* | 8/2006 | Oiwake | F04C 29/026 418/55.6 |
| 2021/0180595 | A1* | 6/2021 | Fagerli | F04C 18/02 |

FOREIGN PATENT DOCUMENTS

| | | | | |
|---|---|---|---|---|
| JP | 2006207494 | A | 8/2006 | |
| JP | 3847321 | B2 | 11/2006 | |
| KR | 20160040936 | A * | 4/2016 | F04C 18/0215 |
| KR | 20170032094 | A | 3/2017 | |

* cited by examiner

DEVICE FOR COMPRESSING A GASEOUS FLUID

CROSS-REFERENCE TO RELATED APPLICATIONS

This patent application claims priority to and the benefit of German Patent Application No. DE 102023103497.9 filed on Feb. 14, 2023 and German Patent Application No. DE 102022109664.5 filed on Apr. 21, 2022, the entire disclosures of each of which are hereby incorporated herein by reference.

TECHNICAL FIELD

The invention relates to a device for compressing a gaseous fluid, in particular for compressing a refrigerant, from a low-pressure section into a high-pressure section. The device has a housing with a housing member, a compression mechanism arranged between the low-pressure section and the high-pressure section as well as a flow duct connecting the high-pressure section to the low-pressure section. The housing member is configured with a high-pressure-side port for discharging the fluid and an oil separator.

BACKGROUND ART

Prior-art compressors for mobile applications, in particular for air-conditioning systems of motor vehicles, for conveying refrigerant through a refrigerant circuit, also referred to as refrigerant compressors, are often configured as variable-displacement piston compressors or as scroll compressors irrespective of the refrigerant.

Due to customer-specific requirements, the applications require a high degree of flexibility in design, for example when arranging and implementing mounting eyelets and screw connections or electrical connections as well as a suction port and a pressure port for connecting the compressor to the refrigerant circuit. As such, the configuration of the pressure port as a connection to components arranged on the high-pressure side, in particular, is more limited than the configuration of the suction port as a connection to components arranged on the low-pressure side.

Either driven via a pulley or electrically, the compressors have a compression mechanism for drawing in, compressing and discharging refrigerant, including the oil for lubrication, and an oil separator for separating the oil from the compressed refrigerant-oil mixture. The compression mechanism and the oil separator are arranged within a housing. As such, the oil separator is configured on the high-pressure side of the compressor in a rear housing member which also has the pressure port as a high-pressure-side port for discharging the refrigerant from the compressor.

The compression mechanism of a scroll compressor has an immovable, fixed stator with a disk-shaped base plate and a scroll-shaped wall extending from one side of the base plate as well as a movable orbiter also with a disk-shaped base plate and a scroll-shaped wall extending from a front side of the base plate. The stator and the orbiter cooperate. As such, the base plates are arranged relative to one another such that the scroll-shaped walls engage with one another in the axial direction and form multiple successive, closed working spaces. Gaps formed in the axial direction between the stator and the orbiter should be minimal, which is ensured by adapting the axial extension of the scroll-shaped walls and hence the heights of the walls together with scaling members applied to the end faces of the walls or by pressing the orbiter against the stator. The pressing of the orbiter against the stator is ensured by means of a counterpressure system.

The refrigerant to be compressed and applied to the working spaces is compressed as a result of the circular movement of the orbiter and ejected from the working space into an outlet chamber via an outlet.

In the direction of flow of the refrigerant or of the refrigerant-oil mixture, the oil separator is arranged downstream of the outlet chamber. As such, an overflow opening from the outlet chamber to the oil separator is configured, for functional reasons, at an upper end of the outlet chamber in the direction of gravity. The oil separator of conventional compressors is aligned with an axis on an axis of an outlet opening of the high-pressure-side port. The arrangement and the orientation of the high-pressure-side port of the compressor for discharging the refrigerant as well as the configuration of the interface are in turn defined and predetermined by the corresponding air-conditioning system, in particular the arrangement of the components of the refrigerant circuit.

The oil separated from the refrigerant-oil mixture in the oil separator after compression of the refrigerant and necessary for lubricating the compressor is recirculated inside of the compressor from the high-pressure side to the low-pressure side, also referred to as the suction side, and hence to the inlet of the compressor through a flow duct of an oil recirculation system during operation of the compressor.

The flow duct of the oil recirculation system, also configured as a component of the counterpressure system, extends substantially axially to the longitudinal axis of the compressor, in particular of the compression mechanism, and is arranged in the lowermost section of the compressor, as far as possible, due to the gravity-based back flow of the oil on the walls of the oil separator as well as the flow duct in the direction of the effect of gravity. The arrangement of the flow duct in the lowermost section of the compressor also allows to configure the outlet chamber with maximum radial extension and hence with maximum volume in order to minimize pressure peaks or pressure pulses occurring during operation of the compressor and transmitted into the refrigerant circuit.

The orientation of the oil separator, especially at an angle to the direction of the effect of gravity, is limited due to the functionality and hence the arrangement of an oil outlet in connection with the arrangement of the flow duct of the oil recirculation system. Thus, the high-pressure-side port of the compressor for discharging the refrigerant is arranged in the uppermost section of the oil separator. As such, for manufacturing reasons, the angular position of the axis of the oil separator is to be formed aligned as far as possible with the angular position of the axis of the high-pressure-side port of the compressor for discharging the refrigerant. In addition, the oil outlet is to be arranged in the lowermost section of the oil separator configured in the rear housing member and is to be brought into connection with the inlet of the flow duct of the oil recirculation system arranged in the lowermost section of the compressor, the inlet being configured in the stator with non-changeable arrangement.

Hence, free orientations of the oil separator or of the high-pressure-side port of the compressor for discharging the refrigerant, which is already bound to customer-specific structural requirements, are very limited regarding the angle to the effect of gravity without significantly redesigning the compressor, in particular the rear housing member. In addition, maintaining boundary conditions, for example with a predetermined position and orientation of the high-pressure-side port, of the flow duct of the oil recirculation system or of screw connections of the housing, may require that the angular position of the axis of the oil separator and the angular position of the axis of the high-pressure-side port of the compressor for discharging the refrigerant may not be configured to be axially aligned, which represents a significant increase in complexity for manufacturing. As such, the magnitude of the possible axial angle deviation also depends on the diameter of the high-pressure-side port.

The prior art teaches scroll compressors in which oil storage chambers are configured in the flow duct of the oil recirculation system, in particular within the rear housing section.

Thus, US 2005 0226756 A1 discloses a scroll compressor having a housing with an outlet chamber for receiving the compressed refrigerant, a duct connecting the outlet chamber to the outlet, a separating device arranged in the duct for separating oil from the refrigerant-oil mixture as well as an oil storage chamber and a pressure relief valve.

U.S. Pat. No. 6,152,713 A also discloses a scroll compressor having a housing with an outlet chamber into which the compressed refrigerant is discharged, and an oil separator as well as an oil storage chamber for storing oil separated from the refrigerant-oil mixture.

The oil storage chambers of the scroll compressors known from the prior art serve as a storage for the oil to be recirculated to the suction side, so that, during operation of the compressor, considerably more oil is supplied through the oil separator than is recirculated from the high-pressure side to the suction side. Furthermore, the volume of the outlet chamber is respectively significantly reduced by the volume of the oil storage chamber leading to high pressure peaks or pressure pulses transmitted into the refrigerant circuit during operation of the compressor.

SUMMARY

The object of the invention is to provide a device for compressing a gaseous fluid, in particular the further development of a scroll compressor, with maximum freedom of design or structural freedom with respect to the angular orientation and position of the outlet opening of the high-pressure-side port for discharging the fluid in connection with an oil separator arranged in alignment with the port. The device is intended to have a simple, standardized connection for connecting it to corresponding ports of further components, for example a fluid circuit, for discharging the fluid, in particular with different orientations, angles and diameters, and to be operated with maximum service life. As such, the generation of high pressure peaks or pressure pulses must also be avoided, which are otherwise transmitted to adjacent components and can destroy the components. The device should be structurally easy to implement, also to keep the costs of production and assembly low.

The object is achieved by the subject-matters having the features as shown and described herein.

The object is achieved by a device according to the invention for compressing a gaseous fluid from a low pressure level in a low-pressure section to a high pressure level in a high-pressure section. The device has a housing with a housing member, a compression mechanism arranged between the low-pressure section and the high-pressure section as well as a flow duct connecting the high-pressure section to the low-pressure section. The housing member is configured with a high-pressure-side port for discharging the fluid and an oil separator. As such, longitudinal axes of the high-pressure-side port, in particular an outlet opening of the port, and of the oil separator are arranged on a common axis.

The outlet opening of the port and an oil outlet are configured at diametrical ends of the oil separator. As such, the oil outlet is arranged in a direction of the effect of gravity in the lowermost section of the oil separator and is hydraulically connected to an inlet of the flow duct connecting the high-pressure section to the low-pressure section.

According to the concept of the invention, the housing member has an inlet chamber into which the oil outlet of the oil separator opens and from which the inlet of the flow duct branches off. According to the invention, the housing member is configured with the inlet chamber such that the high-pressure-side port is able to be arranged with the axis within the inlet chamber, in particular between a first end and a second end of the inlet chamber, irrespective of the arrangement of the oil outlet.

According to a development of the invention, the high-pressure-side port is able to be arranged with the axis in a plane extending perpendicularly to a longitudinal axis of the device. One advantage of the invention is that the high-pressure-side port is able to be arranged with the axis to be variably pivoted in an angular range about an axis of the oil outlet aligned parallel to the longitudinal axis of the device.

Advantageously, the inlet of the flow duct branches off from a lowermost section of the inlet chamber in the direction of the effect of gravity. The inlet chamber is preferably configured with a lateral surface facing outward in a radial direction of the housing member and delimiting the inlet chamber. As such, the lateral surface has a gradient which is continuous with respect to the lowermost section in the direction of the effect of gravity, so that the inlet chamber is flowed through from the oil outlet to the inlet of the flow duct without backing up. The inlet chamber can be configured with any geometric shape which does not considerably reduce the volume of an outlet chamber of the device, on the one hand, and covers a maximum angular range, on the other hand.

According to an advantageous embodiment of the invention, the inlet chamber has the shape of a partial circular ring with a bulge projecting outward from a lateral surface arranged on an outer radius, from which bulge the inlet of the flow duct branches off in the assembled state of the housing.

Due to the gravity-based flow of the oil in the direction of the effect of gravity, the flow duct is arranged in a lower section of the device.

A center point of the partial circular ring preferably corresponds to a center point of the substantially circular housing member. Consequently, the inlet chamber formed as a partial circular ring and the housing member can be arranged concentrically to one another.

According to a development of the invention, the bulge of the inlet chamber has the shape of a funnel tapering in the radial direction of the inlet chamber with a wide section and a narrow section. As such, the narrow section of the funnel forms a lowermost section of the inlet chamber in the direction of the effect of gravity.

According to a preferred embodiment of the invention, the oil outlet of the oil separator is arranged within the partial circular ring of the inlet chamber, which extends in the circumferential direction of the housing member between a first end and a second end. The partial circular ring of the inlet chamber is configured to span, between the ends, an angular range from 30° to 150°, in particular an angular range from 60° to 120°, especially an angular range from 80° to 100°, preferably an angular range of 96°.

One advantage of the invention is that the high-pressure-side port of the housing member is able to be arranged in the angular range from 30° to 150°, in particular the angular range from 60° to 120°, especially in the angular range from 80° to 100°, preferably in the angular range of 96°, with respect to a longitudinal axis of the device.

The bulge of the inlet chamber may be symmetrical or asymmetrical to the shape of the partial circular ring. In a symmetrical configuration of the bulge of the inlet chamber with respect to the shape of the partial circular ring, which also spans an angular range of 120° between the ends, the high-pressure-side port of the housing member can advantageously be able to be arranged in an angular range from 30° to 150° to the horizontal plane and in an angular range from −60° to 60° to the direction of the effect of gravity.

According to a development of the invention, the compression mechanism is configured with an immovable stator with a disk-shaped base plate and a wall configured in a scroll shape extending from one front side of the base plate as well as a movable orbiter with a disk-shaped base plate and a wall of a scroll compressor configured in a scroll shape extending from a front side of the base plate. As such, the wall of the stator and the wall of the orbiter are arranged so as to engage with one another, forming working spaces.

Preferably, the housing member sealingly abuts a rear side of the base plate of the stator such that the inlet chamber is delimited in the direction of the longitudinal axis of the device by the rear side of the base plate. A further advantage of the invention is that the housing member has a contact surface and the fixed scroll has a formation projecting from the base plate, which correspond to one another. As such, the contact surface of the housing member and the formation of the base plate of the fixed scroll are configured such that the contact surface abuts the formation and the inlet chamber is completely delimited in the radial direction by the formation of the fixed scroll.

The inlet chamber can be configured, at least in sections, within the base plate of the stator.

The flow duct is advantageously provided both for recirculating oil as a lubricant for lubricating movable components from the high-pressure section to the low-pressure section and as a component of a counterpressure system for pressing the orbiter against the stator of the compression mechanism.

According to a further preferred embodiment of the invention, the housing member has a rib-shaped web. The web, which is oriented perpendicularly to the common axis of the high-pressure-side port and of the oil separator and extends along the longitudinal axis of the device, is arranged within an outlet chamber of the device.

As such, the web is preferably configured with an extension in the direction of the longitudinal axis of the device such that a gap is formed between a free end face of the web and the rear side of the base plate of the stator.

The advantageous embodiment of the invention allows for the use of the device for compressing the gaseous fluid as a compressor in a refrigerant circuit of an air-conditioning system of a motor vehicle.

The compressor is preferably configured as an electrically driven compressor. As such, the compression mechanism is driven by an electric motor.

In summary, the device according to the invention has various advantages:

- great freedom of design with regard to the high-pressure-side port for discharging the refrigerant, in particular a port variable in position with respect to the angle to the direction of the effect of gravity, and hence
- maximum structural freedom for different versions of the device, especially of the compressor, similar to a highly flexible platform design, in particular without significant redesigns of the compressor, and hence a component-sharing strategy for the internal components of the compressor, such as the components of the compression mechanism, as well as
- maximum service life by avoiding the generation of high pressure peaks or pressure pulses of the fluid.

BRIEF DESCRIPTION OF THE DRAWINGS

Further details, features, and advantages of the invention will become apparent from the following description of exemplary embodiments with reference to the accompanying drawings. In the drawings.

DESCRIPTION OF AN EMBODIMENT OF THE INVENTION

Figure 1A:
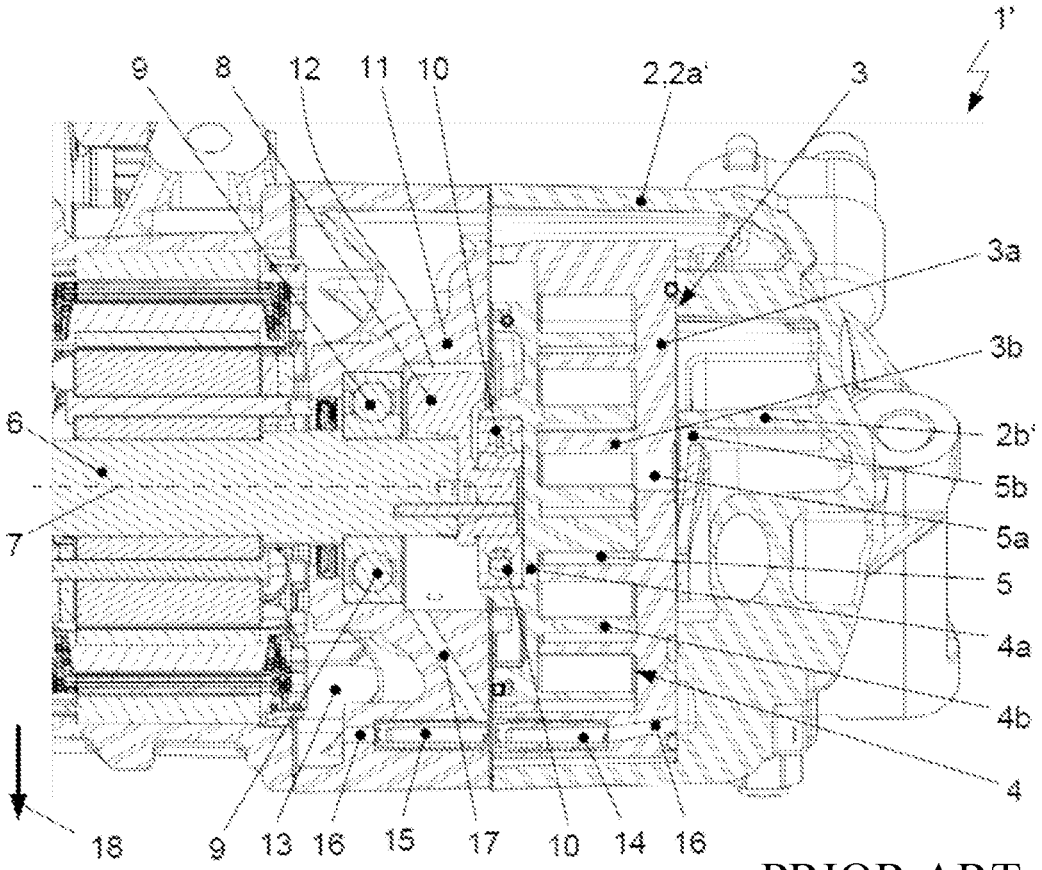
PRIOR ART FIG. 1A
FIG. 1A: shows a device for compressing a gaseous fluid, in particular a scroll compressor, from the prior art with a compression mechanism in a side sectional view.

FIG. 1A illustrates a device 1' for compressing a gaseous fluid, in particular a scroll compactor, from the prior art with a compression mechanism in a side sectional view.

The device 1' has a housing 2, an immovable, fixed stator 3 with a disk-shaped base plate 3*a* and a wall 3*b* configured in a scroll shape extending from one side of the base plate 3*a* as well as a movable orbiter 4 with a disk-shaped base plate 4*a* and a wall 4*b* configured in a scroll shape extending from a front side of the base plate 4*a*. The stator 3 and the orbiter 4, which are also referred to briefly as the immovable or fixed scroll 3 or as a movable scroll 4, respectively, cooperate. As such, the base plates 3*a*, 4*a* are arranged relative to one another such that the wall 3*b* of the stator 3 and the wall 4*b* of the orbiter 4 engage with one another.

The movable scroll 4 is moved on a circular path by means of an eccentric drive. During the movement of the scroll 4, the walls 3*b*, 4*b* contact each other at several points and form multiple successive, closed working spaces 5 within the walls 3*b*, 4*b*, wherein adjacent working spaces 5 delimit volumes of different sizes. In response to the opposite movement of the two scroll-shaped walls 3*b*, 4*b* nested one inside the other, in particular to the movement of the orbiter 4, the volumes and the positions of the working spaces 5 are changed. The volumes of the working spaces 5 become increasingly smaller towards the middle or the center of the scroll-shaped walls 3*b*, 4*b*, which are also referred to as scroll walls. The gaseous fluid to be compressed and applied to the working spaces 5, in particular a refrigerant, is compressed and is ejected from the working chamber 5 into an outlet chamber 5*b* via an outlet 5*a*. Within the outlet chamber 5*b*, a rib-shaped web 2*b*' of the housing member 2*a*' is arranged, dividing the total volume of the outlet chamber 5*b* into partial volumes. The web 2*b*' abuts a rear side of the base plate 3*a* of the stator 3 with an end face, sealing off the partial volumes of the outlet chamber 5*b* from one another.

The eccentric drive is formed by a drive shaft 6 which rotates about an axis of rotation as the longitudinal axis 7 of the device 1' and an intermediate member 8. The drive shaft 6 is supported on the housing 2 via a first bearing 9, in particular a ball bearing. The orbiter 4 is eccentrically connected to the drive shaft 6 via the intermediate member 8, wherein the axes of the orbiter 4 and the drive shaft 6 are arranged offset from one another. The orbiter 4 is supported on the intermediate member 8 via a second bearing 10.

A wall fixed to the housing 2, also referred to as a counter wall 11, is arranged within the housing 2. A counter-pressure chamber 12 is configured between the counter wall 11 and the movable scroll 4. The counter wall 11 delimits the counter-pressure chamber 12 configured between the orbiter 4 and the housing 2 and also forms a partition between the counter-pressure chamber 12 and a suction chamber 13. As such, the counter-pressure chamber 12 is configured on the rear side of the base plate 4*a* of the movable scroll 4 with respect to the scroll-shaped walls 4*b*.

Due to the counter pressure prevailing within the counter-pressure chamber 12, the movable scroll 4 is pressed against the fixed scroll 3 secured to the housing 2 with a force acting in the axial direction corresponding to the longitudinal axis 7, in order to minimize gaps formed in the axial direction between the fixed scroll 3 and the movable scroll 4. The compressive force acting in the axial direction as a result of the counter pressure per surface applied to the rear side of the disk-shaped base plate 4*a* of the movable scroll 4 is controlled or regulated by the counter pressure or contact pressure. As an intermediate pressure or medium pressure, the level of the contact pressure lies between the levels of a high pressure as the outlet pressure and a low pressure as the suction pressure of the compressor.

In addition to the counter-pressure chamber, the counter-pressure system has a first expansion device 14 for expanding the fluid from the level of the high pressure to the level of the counter pressure or the intermediate pressure, as well as a second expansion device 15 for expanding the fluid from the level of the intermediate pressure to the level of the low pressure, each in combination with a control device or a regulating device.

The expansion devices 14, 15, each designed as a throttle member, in particular a nozzle, are arranged in a flow duct 16 connecting the high-pressure section and the low-pressure section to one another and serve to generate the counter pressure. An intermediate space configured within the flow duct 16 between the expansion devices 14, 15 is hydraulically connected to the counter-pressure chamber 12 via a connection duct 17. As such, the first expansion device 14 is arranged between the high-pressure section and the intermediate space and hence the connection duct 17 to the counter-pressure chamber 12, while the second expansion device 15 is arranged between the intermediate space and hence the connection duct 17 to the counter-pressure chamber 12 as well as the suction chamber 13.

The flow duct 16 also constitutes a component of a compressor-internal oil recirculation system for the return flow of oil as a lubricant from the high-pressure section to the low-pressure section of the device 1' and is arranged in a lower section of the device 1' due to the return flow of the oil based on gravity in the direction 18 of the effect of gravity. The high-pressure section is configured within a rear housing member 2*a*'.

Figure 1B:
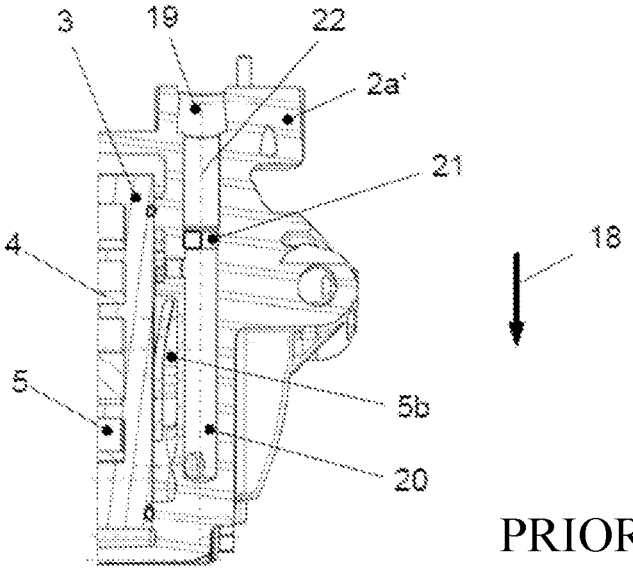
PRIOR ART FIG. 1B
FIG. 1B: shows a portion of a rear housing member of the prior-art device of FIG. 1A with a high-pressure-side port and an integrated oil separator in a side sectional view.

FIG. 1B shows a portion of the rear housing member 2*a*' of the device 1' from the prior art of FIG. 1A with a high-pressure-side port 19 for discharging the compressed fluid, in particular refrigerant, from the device 1' and an integrated oil separator 20 in a side sectional view.

The gaseous fluid, in particular the refrigerant or a refrigerant-oil mixture, compressed within the working spaces 5 and ejected from the working space 5 into the outlet chamber 5*b* through the outlet 5*a* then flows through an overflow opening 21 out of the outlet chamber 5*b* and into the oil separator 20. The overflow opening 21 connecting the outlet chamber 5*b* to the inner volume of the oil separator 20 is configured at an upper end of the outlet chamber 5*b* in the direction 18 of gravity.

A longitudinal axis of the oil separator 20 and a longitudinal axis of an outlet opening of the high-pressure-side port 19 are aligned concentrically to one another and hence on a common axis 22. The arrangement and the orientation of the high-pressure side connection 19 is predetermined by the arrangement of further components of the refrigerant circuit.

The oil separated from the refrigerant-oil mixture in the oil separator 20 is recirculated inside the compressor from the high-pressure side to the low-pressure side of the device 1', in particular from the oil separator 20 into the suction chamber 13, through the flow duct 16 of the oil recirculation system shown in FIG. 1A.

The orientation of the oil separator 20, especially with respect to the longitudinal axis at an angle to the direction 18 of the effect of gravity, is limited due to the functionality and hence the arrangement of an oil outlet in connection with the arrangement of the flow duct 16 of the oil recirculation system. The oil outlet of the oil separator 20 is hydraulically connected to an inlet of the flow duct 16 configured in the fixed scroll 3, the inlet being configured in the stator with non-changeable arrangement. In addition, the outlet opening of the high-pressure-side port 19 is to be provided in the uppermost section of the oil separator 20, while the oil outlet is to be arranged in the lowermost section of the oil separator 20.

Figure 1C:
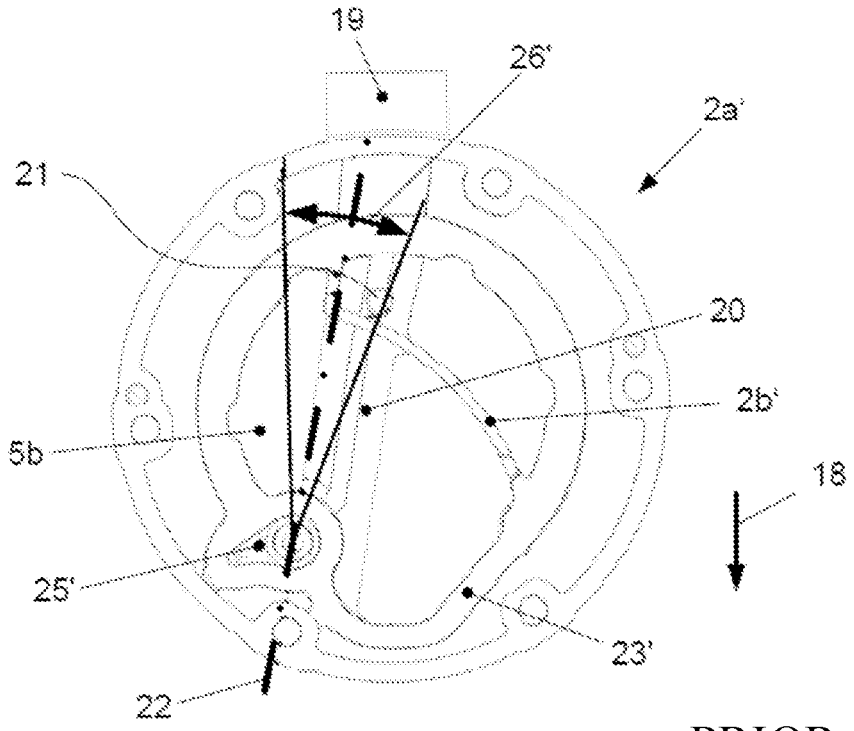
PRIOR ART FIG. 1C
FIG. 1C: shows a rear housing member of the prior-art device with the high-pressure-side port and the integrated oil separator in a plan view.
Figure 1D:
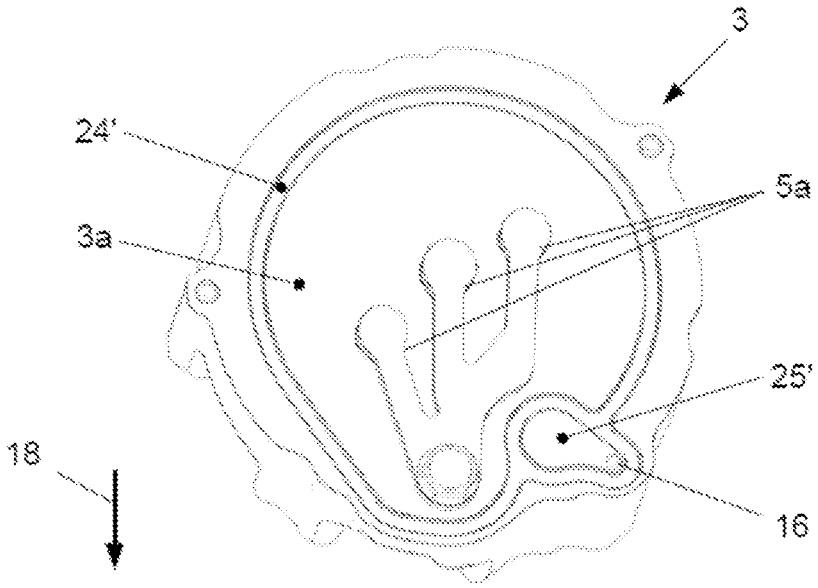
PRIOR ART FIG. 1D
FIG. 1D: shows the stator of the compression mechanism of the prior-art device in a perspective plan view of a rear side of a base plate.

FIG. 1C illustrates the rear housing member 2*a*' of the prior-art device 1' of FIG. 1A with the high-pressure-side port 19 and the integrated oil separator 20 in a plan view, while FIG. 1D shows the fixed scroll 3 of the compression mechanism of the prior-art device 1' of FIG. 1A in a perspective plan view of the rear side of the base plate 3*a*. The rear or aft housing member 2*a*' can be firmly connected, in particular screwed, as a component of the housing 2 to a component of the housing 2 or the fixed scroll 3 arranged nearby or adjacent. As such, the adjacent components are scaled from one another.

In the assembled state of the device 1', the rear housing member 2*a*' and the fixed scroll 3 are scaled from one another, in particular along a contact surface 23' configured on the housing member 2*a*' and a formation 24' configured on the rear side of the base plate 3*a* of the fixed scroll 3, such that the outlet chamber 5*b* is configured. As such, the outlet chamber 5*b* is delimited in the axial direction of the device 1' by the rear side of the base plate 3*a* of the fixed scroll 3, on the one hand, and by the wall of the housing member 2*a*', on the other hand. In the radial direction, the outlet chamber 5*b* is completely surrounded by the formation 24' of the fixed scroll 3. The outlets 5*a* provided in the base plate 3*a* of the fixed scroll 3 and the overflow opening 21 each open into the outlet chamber 5*b*, so that the outlet chamber 5*b* and the inner volume of the oil separator 20 are hydraulically connected to one another via the overflow opening 21.

The contact surface 23' configured on the housing member 2*a*' and the formation 24' projecting from the rear side of the base plate 3*a* of the fixed scroll 3 correspond to one another such that, in the assembled state of the device 1', an inlet 25' for the flow duct 16 is configured in addition to the outlet chamber 5*b*. Like the outlet chamber 5*b*, the inlet 25' is delimited in the axial direction of the device 1' by the rear side of the base plate 3*a* of the fixed scroll 3, on the one hand, and by the wall of the housing member 2*a*' as well as, in the radial direction, by the formation 24' of the fixed scroll 3, on the other hand. The formation 24' completely surrounds the inlet 25' and delimits the inlet 25' from the outlet chamber 5*b*. Between the contact surface 23' with the web 2*b*' of the housing member 2*a*' and the formation 24' on the base plate 3*a* of the fixed scroll 3, a sealing element is arranged which also corresponds to the contact surface 23' and the formation 24'. The web 2*b*' of the housing member 2*a*' abuts directly on the rear side of the base plate 3*a* of the fixed scroll 3.

On the one hand, the oil outlet of the oil separator 20 integrated in the housing member 2*a*' opens into the inlet 25', while, on the other hand, the flow duct 16 running through the base plate 3*a* of the fixed scroll 3 also branches off from the inlet 25', so that the oil outlet of the oil separator 20 and the flow duct 16 are hydraulically connected to one another via the inlet 25'. As such, the high-pressure-side port 19 is arranged in the direction 18 of the effect of gravity in the uppermost section and the oil outlet is arranged in the lowermost section of the oil separator 20. In addition, the longitudinal axes of the oil separator 20 as well as the port 19 are aligned on the common axis 22, which greatly limits the possible alignment of the port 19 with the oil separator 20 to a small alignment section 26' as an angle of rotation about the longitudinal axis 7 of the device 1'.

Figure 2A:
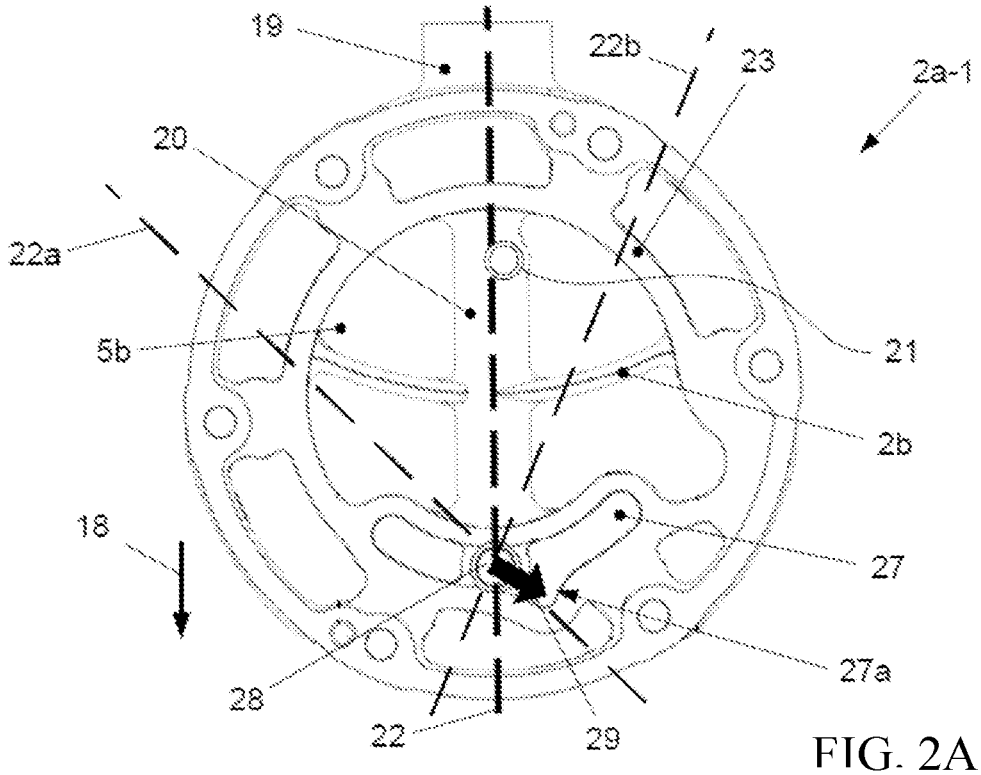
FIG. 2A: shows a rear housing member of a device according to the invention with the high-pressure-side port and the integrated oil separator in a first embodiment in a plan view.
Figure 2B:
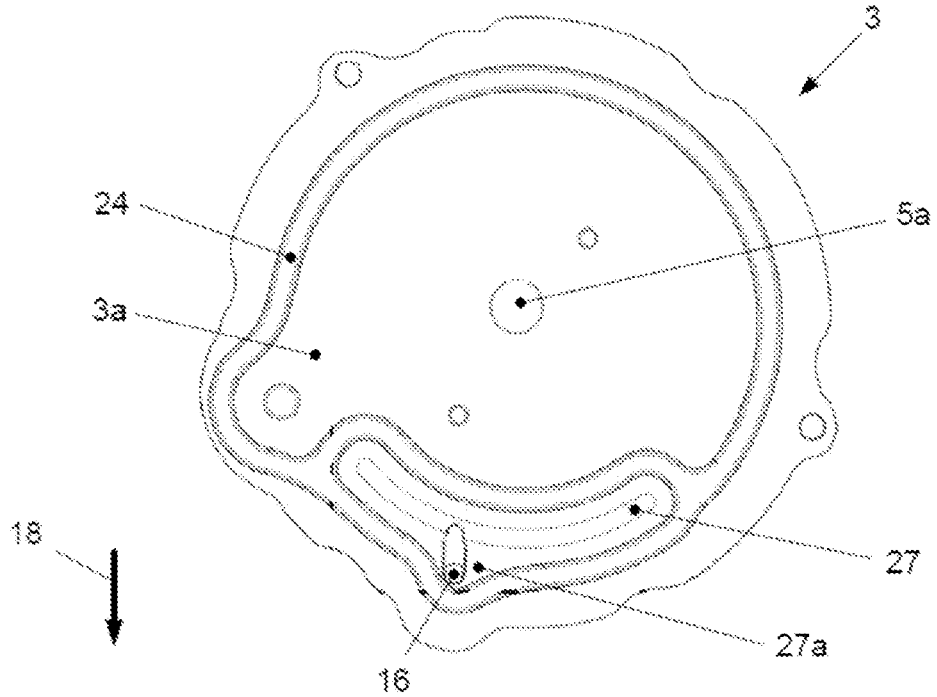
FIG. 2B: shows the stator of the compression mechanism of the device according to the invention in a plan view of the rear side of the base plate.

FIG. 2A illustrates the rear housing member 2*a*-1 of a device 1 according to the invention with the high-pressure-side port 19 and the integrated oil separator 20 in a first embodiment in a plan view, while FIG. 2B illustrates the fixed scroll 3 of the compression mechanism of the device 1 according to the invention in a plan view of the rear side of the base plate 3*a*. The components which are identical in comparison to the device 1' shown in FIGS. 1C and 1D are provided with the same reference numerals.

A substantial difference between the prior-art device 1' according to FIGS. 1C and 1D, on the one hand, and the device 1 according to the invention, on the other hand, is the configuration of the inlet chamber 27 for the flow duct 16 delimited in the axial direction of the device 1 by the rear side of the base plate 2*a* of the fixed scroll 3 and the wall of the housing member 2*a*-1 as well as in the radial direction by the formation 24 of the fixed scroll 3. The formation 24 projecting from the fixed scroll 3 corresponds to the contact surface 23 configured on the housing member 2*a*-1, which is configured as an end face of a wall of the housing member 2*a*-1, pointing in the axial direction. Hence, the formation 24 of the fixed scroll 3 encloses the inlet chamber 27 in connection with the wall of the housing member 2*a*-1 in the axial direction of the device 1. In addition to the formation 24 raised in the axial direction, a depression extending in the axial direction and counter to the formation 24 can be configured in the area of the inlet chamber 27 in the base plate 3*a* of the fixed scroll 3, which depression corresponds to the geometry of the formation 24 in this area to adapt the volume of the inlet chamber 27 or to vary the cross section of the inlet chamber 27 and hence the inlet of the flow duct 16. Between the contact surface 23 configured on the housing member 2*a*-1 and the formation 24 projecting from the base plate 3*a* of the fixed scroll 3, a sealing element is in turn provided which corresponds to both the contact surface 23 and the formation 24.

The inlet chamber 27 configured within the rear housing member 2*a*-1 or the base plate 3*a* of the fixed scroll 3 has an elongated shape, in particular substantially the shape of a partial circular ring or crescent. The center point of the partial circular ring corresponds to the center point of the substantially circular housing member 2*a*-1.

With the elongated shape of the inlet chamber 27, the reduction of the volume of the outlet chamber 5*b* within the housing member 2*a*-1 can be reduced, on the one hand, and the flow resistance can be reduced, on the other hand. As such, the cross-section of the transition from the inlet chamber 27 to the flow duct 16, in particular to the inlet of the flow duct 16, is configured such that the flow resistance of the flow duct 16 is not or only insignificantly influenced, on the one hand, and the inflow of the oil into the inlet chamber 27 as well as the outflow of the oil from the inlet chamber 27 are at least substantially the same, on the other hand.

Consequently, in comparison to devices from the prior art, the inlet chamber 27 of the device 1 does not serve as an oil storage, in particular not as an oil storage chamber, since the quantity of oil flowing from the oil separator 20 into the inlet chamber 27 corresponds to the quantity of oil discharged from the inlet chamber 27 and passed through the flow duct 16 to the suction side of the device 1.

As such, with a bulge 27*a*, the inlet chamber 27 also has such a shape that the inlet of the flow duct 16 arranged in the direction 18 of the effect of gravity at the lowermost section of the inlet chamber 27 branches off from the inlet chamber 27 without a dead volume which would constitute an oil trap. The bulge 27*a* forming the lowermost section of the inlet chamber 27 in the direction 18 of the effect of gravity is provided on the outside of the cross section of the inlet chamber 27 and hence on the lateral surface of the circular ring arranged on the outer radius. The inlet of the flow duct 16 is arranged within the bulge 27*a* of the inlet chamber 27. The shape of the inlet chamber 27 is free of oil traps so that all the oil always flows from the inlet chamber 27 into the flow duct 16.

The oil outlet 28 of the oil separator 20 opens into the inlet chamber 27 as the lowermost section of the oil separator 20 in the direction 18 of the effect of gravity, so that all the oil always flows from the oil separator 20 into the inlet chamber 27 and flows into the flow duct 16 through the bulge 27*a* via the shortest flow path 29.

As common longitudinal axes of the oil separator 20 as well as the port 19, the indicated axes 22*a*, 22*b* illustrate that the alignment of the oil separator 20, especially of the high-pressure-side port 19, is variable within the inlet chamber 27 with an unchanged arrangement of the oil outlet 28. As such, the axes 22*a*, 22*b* are each arranged on a plane perpendicular to the longitudinal axis 7 of the device 1, rotated about an axis of the oil outlet 28 of the oil separator 20 aligned parallel to the longitudinal axis 7 of the device 1.

In order to reduce the volume of the outlet chamber 5*b* as little as possible with the same installation space, the volume and, in particular, the cross section of the inlet chamber 27 aligned in the axial direction are configured minimally in the radial direction. In addition, the contact surface 23 of the housing member 2*a*-1 has a smaller width in comparison to the housing member 2*a*' of the prior-art device 1' of FIGS. 1C and 1*s* arranged substantially completely circumferentially displaced outward in the radial direction. The radial extension of the circular ring and hence the volume of the inlet chamber 27 are minimal. As such, the size of the cross section is predetermined by manufacturing possibilities. The inlet chamber 27 can be produced both within the housing member 2*a*-1 and within the base plate 3*a* of the fixed scroll 3 by primary shaping or machining.

Since the pulsation behavior of the device 1 is substantially determined by the inner total volume of the high-pressure side of the device 1, which is composed of the volume of the outlet chamber 5*b*, the volume of the oil separator 20 not filled with oil and thus free, plus the volume of the port 19, the volume of the inlet chamber 27 and the volume of the flow duct 16 not filled with oil up to the first expansion device 14, and remains unchanged in comparison to the device 1' from the prior art, the pulsation behavior of the device 1 also remains unchanged in comparison to the device 1' known from the prior art.

A further substantial difference between the device 1' according to FIGS. 1C and 1D from the prior art, on the one hand, and the device 1 according to the invention, on the other hand, is the configuration of the rib-shaped web 2*b* of the rear housing member 2*a*-1 within the outlet chamber 5*b*. The web 2*b* serves to increase the stiffness of the housing member 2*a*-1 and is substantially aligned perpendicularly to the axis 22 as the longitudinal axis of the oil separator 20 and the longitudinal axis of the port 19, on the one hand, and preferably extending along the longitudinal axis 7 of the device 1, on the other hand.

The web 2*b* is configured with an extension in the direction of the longitudinal axis 7 of the device 1 such that a gap is formed between a free end face of the web 2*b* and a rear side of the base plate 3*a* of the stator 3. As such, the end face of the web 2*b* and the rear side of the base plate 3*a* of the stator 3 are arranged apart from one another such that the outlet chamber 5*b* has, instead of partial volumes, a continuous volume in which a substantially uniform pressure prevails with the high pressure. Within the outlet chamber 5*b*, there are no or only negligible pressure differences.

The web 2*b* is configured as a fixed component of the housing member 2*a*-1 always perpendicular to the axis 22, so that, when the arrangement of the housing member 2*a*-1 is varied by an angle of rotation about the longitudinal axis 7 of the device 1, the arrangement of the web 2*b* is varied in the same manner.

Figure 3A:
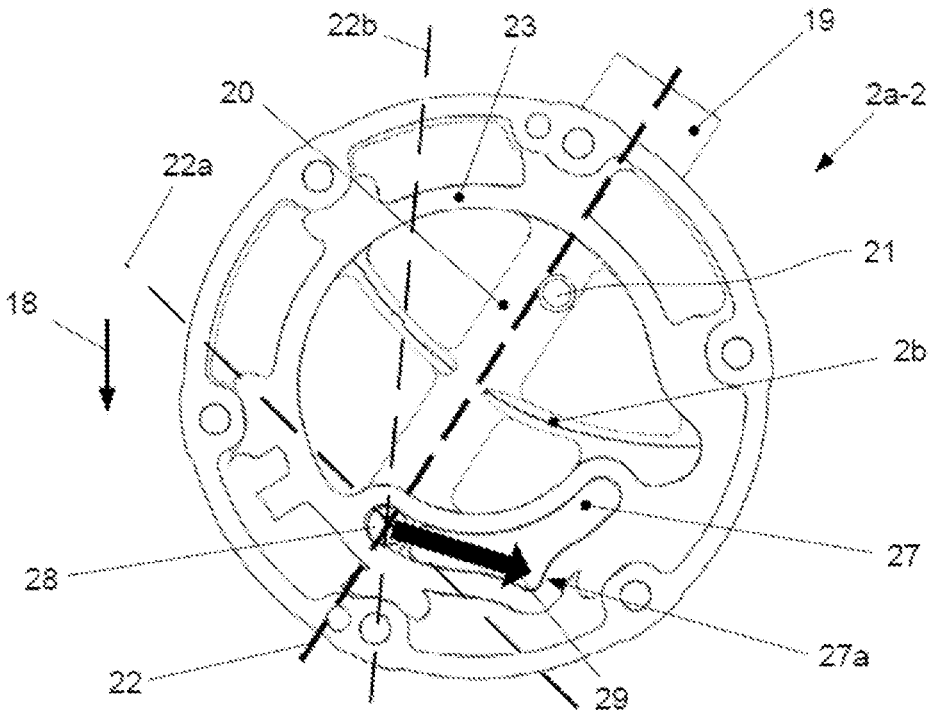
FIGS. 3A and 3B: show the rear housing member of FIG. 2A in a second and in a third embodiment, each with a maximum deflection of the high-pressure-side port about a longitudinal axis of the device in a plan view.
Figure 3B:
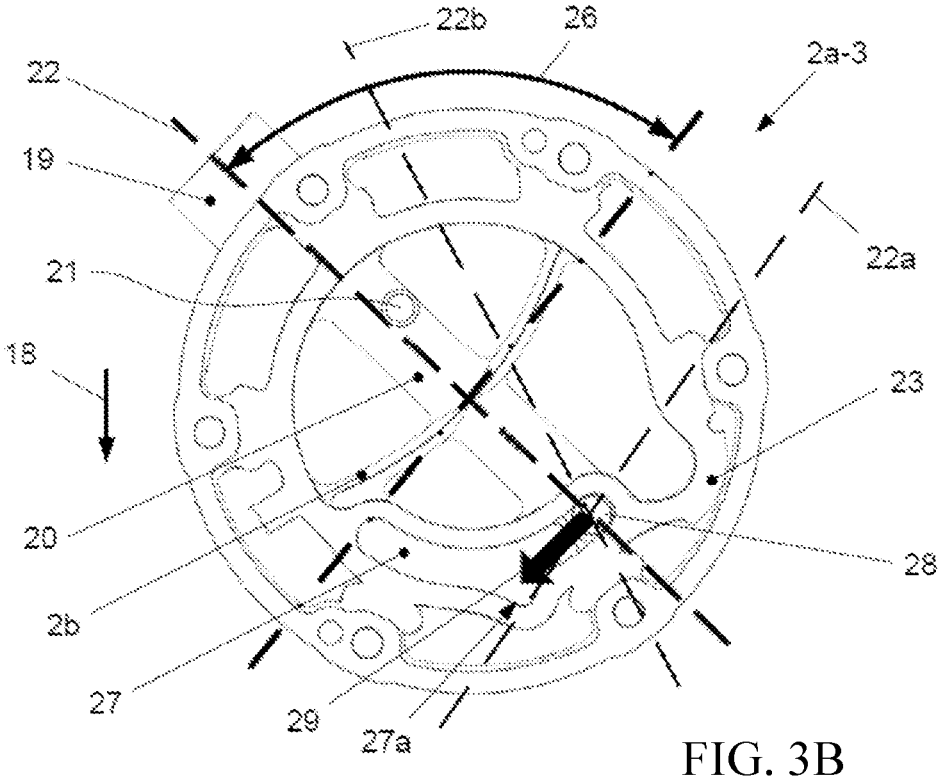

According to FIGS. 3A and 3B, the special configuration of the inlet chamber 27 results in a wide alignment section 26 as the angle of rotation of the alignment of the port 19 with the oil separator 20 about the longitudinal axis 7 of the device 1 with respect to the housing 2, which is otherwise arranged unchanged, or the base plate 3*a* of the fixed scroll 3 with the formation 24 projecting from the rear side of the base plate 3*a*, in particular the angular orientation and position of the outlet opening of the high-pressure-side port 19 for discharging the refrigerant in connection with the oil separator 20 arranged in alignment with the port 19 and of the oil outlet 28 of the oil separator 20.

FIGS. 3A and 3B show the rear housing member 2*a*-2, 2*a*-3 in a second and in a third embodiment in a plan view, each with a maximum deflection of the port 19 with the oil separator 20 about the longitudinal axis 7 of the device 1, especially to the housing 2 otherwise arranged unchanged and not shown. As such, the inlet chamber 27 is configured between a first end in the circumferential direction of the housing member 2*a*-2, 2*a*-3 and a second end for an alignment section 26 with an angular overlap of 96°. Depending on the shape and extension of the inlet chamber 27, the alignment section 26 can cover an angle in the range from 30° to 150° to the horizontal plane.

The housing members 2*a*-2, 2*a*-3, each with a different orientation of the axes 22 of the port 19 and of the oil separator 20, have an identically configured contact surface 23 for abutting the housing 2 or the rear side of the base plate 3*a* of the fixed scroll 3 with the formation 24 corresponding to the contact surface 23, so that, depending on the requirement for the orientation of the axis 22, a corresponding housing member 2*a*-1, 2*a*-2, 2*a*-3 is used for connecting the device 1 to the port 19 in the refrigerant circuit.

As such, the cross-section of the inlet chamber 27 oriented in the axial direction can be configured symmetrically or asymmetrically with respect to an axis extending in the direction 18 of the effect of gravity, so that the alignment section 26 can extend between ±60° with respect to the axis oriented in the direction 18 of the effect of gravity, also referred to as the normal axis of the device 1. Consequently, the axis of the port 19 and of the oil separator 20 can vary in the range of ±60° with respect to the normal axis of the device 1 extending in the vertical direction.

The high-pressure-side port 19 and the oil separator 20 can be arranged such that the axis 22 of the port 19 and of the oil separator 20 as well as the longitudinal axis 7 of the device 1 intersect, especially in a center point of the housing member 2*a*-2, 2*a*-3. As such, the longitudinal axis 7 and the axis 22 are oriented perpendicularly to one another.

With the same angular position of the axis 22 of the high-pressure-side port 19 and of the oil separator 20, the axis 22*a*, 22*b* can also be arranged apart from the longitudinal axis 7 of the device 1. The axis 22*a* of the housing member 2*a*-2 of FIG. 3A shows the orientation of the axis 22 of the housing member 2*a*-3 of FIG. 3B, while the axis 22*a* of the housing member 2*a*-3 of FIG. 3B shows the orientation of the axis 22 of the housing member 2*a*-2 of FIG. 3A. The axis 22*b* respectively illustrates an intermediate position of the orientation of the high-pressure-side port 19 and of the oil separator 20.

Irrespective of the orientation of the axes 22, 22*a*, 22*b* of the high-pressure-side port 19 and of the oil separator 20, the oil outlet 28 of the oil separator 20 always opens into the inlet chamber 27 as the lowermost section of the oil separator 20 in the direction 18 of the effect of gravity such that the all the oil flows from the oil separator 20 into the inlet chamber 27 and flows into the flow duct 16 through the bulge 27*a* via the shortest flow path 29. Oil is not applied to the remaining section of the inlet chamber 27 since the quantity of oil flowing from the oil separator 20 into the inlet chamber 27 corresponds to the quantity of oil which is discharged from the inlet chamber 27.

As common longitudinal axes of the oil separator 20 as well as of the port 19, the respectively indicated axes 22*a*, 22*b* illustrate that the orientation of the oil separator 20, especially of the high-pressure-side port 19, can be varied irrespective of the arrangement of the oil outlet 28 within the inlet chamber 27, in particular between the first end and the second end of the inlet chamber 27, even if the arrangement of the oil outlet 28 within the inlet chamber 27 remains unchanged.

In addition, the entire housing member 2*a*-1, 2*a*-2, 2*a*-3 with the inlet chamber 27 can also be arranged rotated about the longitudinal axis 7 of the device 1 in any case. The variation of the rotation is limited only such that the bulge 27*a* in the direction 18 of the effect of gravity always forms the lowermost point of the inlet chamber 27 as well as the inlet of the flow duct 16. The base plate 3*a* of the fixed scroll 3, in particular the formation 24 on the rear side of the base plate 3*a*, is to be adapted accordingly.

LIST OF REFERENCE NUMERALS

| | |
|---|---|
| 1, 1' | Device |
| 2 | Housing |
| 2a-1, 2a-2, 2a-3, 2a' | Housing member |
| 2b, 2b' | Web |
| 3 | Stator, fixed scroll |
| 3a | Fixed scroll 3 base plate |
| 3b | Fixed scroll 3 wall |
| 4 | Orbiter, movable scroll |
| 4a | Movable scroll 4 base plate |
| 4b | Movable scroll 4 wall |
| 5 | Working space |
| 5a | Outlet |
| 5b | Outlet chamber |
| 6 | Drive shaft |
| 7 | Longitudinal axis |
| 8 | Intermediate member |
| 9 | First bearing |
| 10 | Second bearing |
| 11 | Counter wall |
| 12 | Counter-pressure chamber |
| 13 | Suction chamber |
| 14 | First expansion device |
| 15 | Second expansion device |
| 16 | Flow duct |
| 17 | Connection duct |
| 18 | Direction of the effect of gravity |
| 19 | Port |
| 20 | Oil separator |
| 21 | Overflow opening |
| 22, 22a, 22b | Axis |
| 23, 23' | Contact surface |
| 24, 24' | Formation |
| 25' | Inlet |
| 26, 26' | Alignment section |
| 27 | Inlet chamber |
| 27a | Bulge |
| 28 | Oil outlet |
| 29 | Flow path |

What is claimed:

1. A device for compressing a gaseous fluid from a low pressure level in a low-pressure section to a high pressure level in a high-pressure section, the device comprising a housing with a housing member, a compression mechanism arranged between the low-pressure section and the high-pressure section as well as a flow duct connecting the high-pressure section to the low-pressure section, wherein the housing member is configured with a high-pressure-side port and an oil separator, longitudinal axes of which are arranged on a common axis, wherein an outlet opening of the high-pressure-side port and an oil outlet are configured at diametrical ends of the oil separator, wherein the oil outlet is arranged in a direction of an effect of gravity in a lowermost section of the oil separator and is hydraulically connected to an inlet of the flow duct, wherein the housing member is configured with an inlet chamber into which the oil outlet is arranged to open and from which the inlet of the flow duct is arranged to branch off such that the high-pressure-side port is able to be arranged with the common axis within the inlet chamber, in particular between a first end and a second end of the inlet chamber, irrespective of an arrangement of the oil outlet, and wherein the inlet chamber has a lateral surface facing outward in a radial direction of the housing member and delimiting the inlet chamber, and wherein the inlet chamber has a shape of a partial circular ring with a bulge projecting outward from the lateral surface arranged on an outer radius, from which the inlet of the flow duct is arranged to branch off.

2. The device according to claim 1, wherein the high-pressure-side port is able to be arranged with the common axis in a plane extending perpendicularly to a longitudinal axis of the device.

3. The device according to claim 2, wherein the high-pressure-side port is able to be arranged with the common axis to be variably pivoted in an angular range about an axis of the oil outlet aligned parallel to the longitudinal axis of the device.

4. The device according to claim 2, wherein the high-pressure-side port of the housing member is able to be arranged in an angular range from 30° to 150° with respect to the longitudinal axis of the device.

5. The device according to claim 1, wherein the inlet of the flow duct is arranged to branch off from a lowermost section of the inlet chamber in the direction of the effect of gravity.

6. The device according to claim 5, wherein the lateral surface has a gradient which is continuous with respect to the lowermost section of the inlet chamber in the direction of the effect of gravity, so that the inlet chamber is flowed through from the oil outlet to the inlet of the flow duct without backing up.

7. The device according to claim 1, wherein a center point of the partial circular ring corresponds to a center point of the substantially circular housing member.

8. The device according to claim 1, wherein the bulge of the inlet chamber is configured in a shape of a funnel tapering in the radial direction of the inlet chamber with a wide section and a narrow section, wherein the narrow section of the funnel forms the lowermost section of the inlet chamber in the direction of the effect of gravity.

9. The device according to one of claims 7 to 8, wherein the oil outlet of the oil separator is arranged within the partial circular ring of the inlet chamber, which has the first end and the second end in a circumferential direction of the housing member.

10. The device according to claim 9, wherein the partial circular ring of the inlet chamber has, between the ends, an angular range from 30° to 150°.

11. The device according to claim 1, wherein the bulge of the inlet chamber is configured symmetrically or asymmetrically with respect to the shape of the partial circular ring.

12. The device according to claim 11, wherein the high-pressure-side port of the housing member is able to be arranged in a symmetrical configuration of the bulge of the inlet chamber with respect to the shape of the partial circular ring in an angular range between 30° and 150° to the horizontal plane and in an angular range from −60° to 60° to the direction of the effect of gravity.

13. The device according to claim 1, wherein the compression mechanism is configured with an immovable stator with a disk-shaped base plate and a wall configured in a scroll shape extending from a front side of the base plate as well as a movable orbiter with a disk-shaped base plate and a wall of a scroll compressor configured in a scroll shape extending from a front side of the base plate, wherein the wall of the stator and the wall of the orbiter are arranged to engage with one another.

14. The device according to claim 13, wherein the housing member is arranged to sealingly abut a rear side of the base plate of the stator such that the inlet chamber is delimited in the direction of a longitudinal axis of the device from the rear side of the base plate.

15. The device according to claim 14, wherein the housing member has a contact surface and the immovable stator has a formation projecting from the base plate, which are configured in correspondence with one another such that the contact surface abuts the formation and the inlet chamber is completely delimited in a radial direction by the formation of the immovable stator.

16. The device according to claim 14, wherein the inlet chamber is configured, at least in sections, within the base plate of the stator.

17. The device according to claim 13, wherein the flow duct is configured for recirculating the oil as a lubricant from the high-pressure section to the low-pressure section and as a component of a counterpressure system for pressing the orbiter against the stator.

18. The device according to claim 13, wherein the housing member has a rib-shaped web which is aligned perpendicularly to the common axis and extends along a longitudinal axis of the device and is arranged within an outlet chamber.

19. The device according to claim 18, wherein the web is configured with an extension in the direction of the longitudinal axis of the device such that a gap is formed between a free end face of the web and a rear side of the base plate of the stator.

* * * * *